US008192245B2

(12) United States Patent
Deutsch et al.

(10) Patent No.: US 8,192,245 B2
(45) Date of Patent: Jun. 5, 2012

(54) VENT SEAL FOR INFLATABLE DEVICES

(75) Inventors: Robert Deutsch, Rockville, MD (US); Shane Spruill, Silver Spring, MD (US)

(73) Assignee: Deutsch Inc., Rockville, MD (US)

( * ) Notice: Subject to any disclaimer, the term of this patent is extended or adjusted under 35 U.S.C. 154(b) by 262 days.

(21) Appl. No.: 12/795,070

(22) Filed: Jun. 7, 2010

(65) Prior Publication Data

US 2011/0297247 A1 Dec. 8, 2011

(51) Int. Cl.
*A63H 3/06* (2006.01)

(52) U.S. Cl. ..... 446/222; 5/706; 137/223

(58) Field of Classification Search ..... 137/223, 137/232, 233, 613; 220/240, 243, 244, 245, 220/256.1, 259.2, 360; 446/220–226; 5/706–715
See application file for complete search history.

(56) References Cited

U.S. PATENT DOCUMENTS

| | | | | |
|---|---|---|---|---|
| 5,379,810 | A * | 1/1995 | Marino | 141/10 |
| 5,511,573 | A * | 4/1996 | Corte | 137/15.16 |
| 6,008,938 | A | 12/1999 | Suehle | |
| 7,446,937 | B2 | 11/2008 | Poretskin | |
| 2004/0221394 | A1 * | 11/2004 | See | 5/706 |
| 2005/0046183 | A1 * | 3/2005 | Adams et al. | 285/260 |
| 2008/0116673 | A1 * | 5/2008 | Kim | 280/742 |
| 2010/0285910 | A1 * | 11/2010 | Spector | 473/596 |

FOREIGN PATENT DOCUMENTS

AU 2006100011 A4 * 2/2006

* cited by examiner

*Primary Examiner* — Eric Keasel
*Assistant Examiner* — R. K. Arundale

(57) ABSTRACT

A seal for vent openings of inflatable structures is provided that includes an interior and an exterior component that can be affixed to each other and to the inflatable structure and allows for higher pressures to be maintained within the inflatable structure.

19 Claims, 1 Drawing Sheet

VENT SEAL FOR INFLATABLE DEVICES

CROSS-REFERENCE TO RELATED APPLICATIONS

None.

STATEMENT REGARDING FEDERALLY SPONSORED RESEARCH OR DEVELOPMENT

Not applicable.

FIELD OF THE INVENTION

The invention relates to seals for vent openings of inflatable structures.

BACKGROUND OF THE INVENTION

Inflatable structures are used for a variety purposes, including mattresses, light towers, image screens, tents, and play structures. Inflatable structures are most often used on a temporary basis and therefore it is desirable that they be easily set up and taken down as well as easily stored and transported. Therefore it is desirable for inflatable structures to have vents equipped with seals that can be relatively easily opened and closed. In addition, it is desirable for many inflatable structures to be able to use higher air pressures so that the structures can be smaller and thus lighter when handling and transporting and more compact for storage. Prior art seals have included zipper and screw cap mechanisms. However, zippers tend to allow leakage that can result in pressure loss and screw caps can be lost or deformed while in storage or transit.

Therefore, a need exists for a vent seal that is lightweight, does not become deformed or get lost, and resists air leakage at higher pressures.

It is an object of the invention to provide a vent seal that is easily opened and closed, will not get lost or deformed, and can maintain higher pressures within inflatable structures.

SUMMARY OF THE INVENTION

A vent seal is provided comprising an inner component and an outer component with the inner component attached to the inside of an inflatable structure near a vent opening and with the outer component attached to the outside of the inflatable structure near the vent opening. At least the inner surface of the outer component, the outer surface of the inner component, and the outer surface of the inflatable structure around the area of the vent opening include hook and loop fastener material arranged such that the inner component, outer component, and material of the inflatable structure are fastened together when the seal is closed.

In another aspect of the invention, the inner surface of the inflatable material around the vent opening also includes hook and loop fastener material.

In another aspect of the invention, the area of the inner component that covers the vent opening when closed and the area of the outer component that covers the vent opening when closed have opposing hook and loop sides of the hook and loop fastener material.

In another aspect of the invention, the vent seal of the present invention is included on an inflatable device for a screen.

DETAILED DESCRIPTION OF PREFERRED EMBODIMENTS

Inflatable structures are made of a vinyl material or other materials known in the art. The materials can be sewn together or heat or RF welded together to form the inflatable structure. The inflatable structures have at least one air inlet to which a blower can be connected for inflating the structure. To facilitate deflation, inflatable structures include vents. The vents are closed during inflation and use and are opened during deflation.

Figure 1:
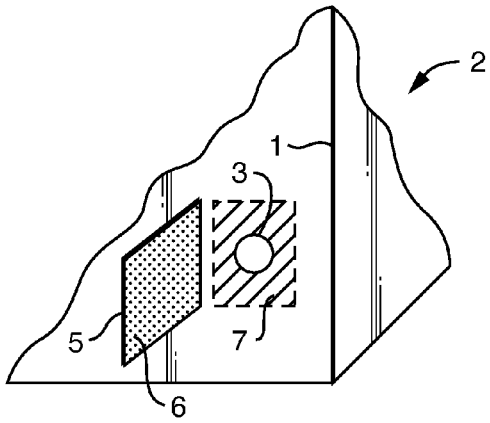
FIG. 1 shows an embodiment of a vent seal of the present invention from the outside of a cut-away inflatable structure.

FIG. 1 shows an embodiment of a vent seal of the present invention. A wall 1 of an inflatable structure 2 is shown. The wall 1 contains a vent hole 3. The seal includes two flaps, an inner flap (not visible in FIG. 1) and an outer flap 5. Outer flap 5 is attached to the wall 1 of the inflatable structure 2 on the outside of inflatable structure 2. The outer flap 5 can be made of a material similar to the walls of inflatable structures or other suitable material. The outer flap can be attached by sewing or heat or RF welding. The attachment may be so as to be removable or may be generally permanent. Any suitable shape can be used for the outer flap, including square or rectangular, other polygon, irregular, and rounded, so long as the shape can cover the vent hole when closed.

Outer flap 5 includes hook and loop fastener material on the inner side 6 of the outer flap 5. The inner side 6 is the side that covers and faces vent hole 3 when the outer flap 5 is closed. Either the "hook" portion or the "loop" portion may be used, with the opposite "hook" or "loop" portion being included on outer surface area 7 around vent hole 3 so that inner side 6 of outer flap 5 will be affixed to outer surface area 7 when outer flap 5 is closed. Notably, the portion of the inner side 6 of outer flap 5 that will generally align with vent hole 3 when closed includes hook and loop fastener material as well.

Figure 2:
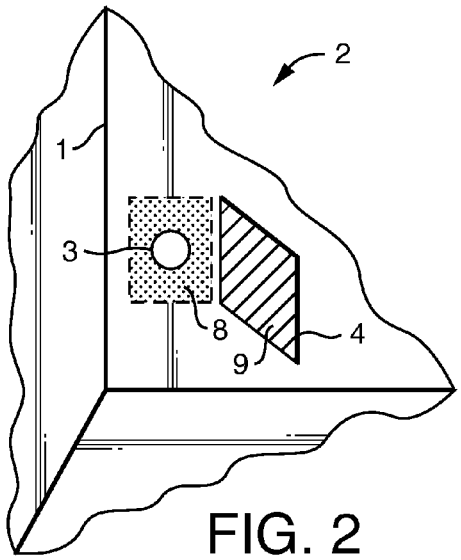
FIG. 2 shows an embodiment of a vent seal of the present invention from the inside of the inflatable structure of FIG. 1.

Inner flap 4, which is shown in FIG. 2, which depicts an interior section of inflatable structure 2, is attached to the wall 1 of the inflatable structure 2 on an inside surface of inflatable structure 2. The inner flap 4 can be made of a material similar to the walls of inflatable structures or other suitable material. The inner flap can be attached by sewing or heat or RF welding. The attachment may be so as to be removable or may be generally permanent. Any suitable shape can be used for the inner flap, including square or rectangular, other polygon, irregular, or rounded, so long as the shape can cover the vent hole.

Inner flap 4 includes hook and loop fastener material on vent side 9 of the inner flap 4. Vent side 9 is the side of inner flap 4 that covers and faces the vent hole 3 when inner flap 4 is closed. Either the "hook" portion or the "loop" portion may be used, with the opposite portion being included on the inner surface area 8 of inflatable structure 2 around vent hole 3 so that a seal will be formed when vent side 9 of inner flap 4 comes into contact with inner surface area 8. Preferably, the hook and loop portion (either the "hook" or "loop" portion) used on side 9 of inner flap 4 is the opposite (or counterpart) of the portion used on the inner side 6 of outer flap 5 so that the part of inner flap 4 that covers vent hole 3 when closed will affix to the inner side 6 of outer flap 5 when both flaps are closed. For example, if inner flap 4 has "hook" portion material on vent side 9, then both inner surface area 8 and the inner side 6 of outer flap 5 would have "loop" portion material, and outer surface area 7 would have "hook" portion material.

Figure 3:
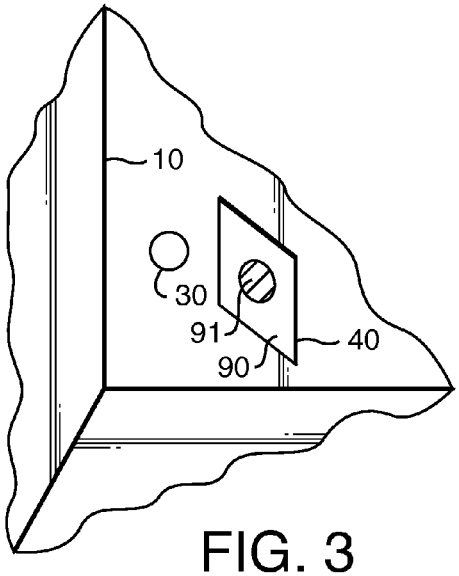
FIG. 3 shows another embodiment of a vent seal of the present invention from the inside of a cut-away of an inflatable structure.

Alternatively, in another embodiment, shown in FIG. 3, an inner side 90 of inner flap 40 can include appropriately hole-shaped hook and loop fastener material 91 only on the portion of inner side 90 that aligns with vent hole 30 when the inner flap 40 is in a closed position. In this configuration, the inner flap 40 would be affixed to the outer flap (not visible in FIG. 3) when the seal is closed but not be affixed via a hook and loop fastener directly to a wall 10 of inflatable structure 20 around vent hole 30. In this embodiment, all the hook and loop fastener engagements of the seal are opened when the outer flap is opened.

Figure 4:
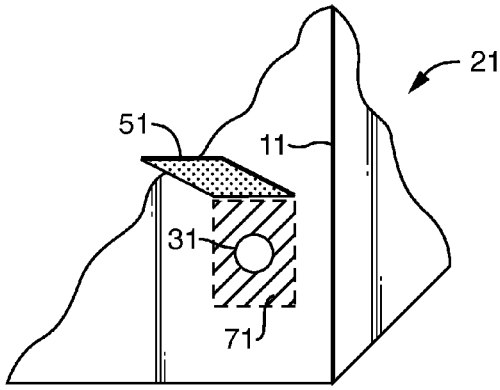
FIG. 4 shows an embodiment of a vent seal of the present invention from the outside of a cut-away inflatable structure.

In another embodiment, as shown in FIG. 4, outer flap 51 and the inner flap (not visible in FIG. 4) are attached to wall 11 of inflatable structure 21 above vent hole 31.

Other suitable fastener materials may be used with this invention.

In operation, when an inflatable device is to be inflated, inner flap 4 and then outer flap 5 are closed over vent hole 3. As air pressure is increased inside the inflatable structure, the air pressure exerts an outward force upon inner flap 4, thereby pushing inner flap 4 against vent hole 3 rather than away from it. In this manner, the improved vent seal resists leakage and is less likely to fail during use of the inflatable device. In addition, the seals of the present invention allow for higher pressures to be maintained in the inflatable structure with reduced leakage, thereby enabling smaller structures to be used.

When the inflatable structure is to be deflated, outer flap 5 can be pulled open and then inner flap 4 can be pushed into the inside of the inflatable structure.

The vent seals of the present invention can be used for vent holes of almost any size and are appropriate for use in conjunction with a variety of inflatable structures including inflatable image screens, air mattresses, inflatable light towers, inflatable play structures, and inflatable tents, as examples.

The invention claimed is:

1. A vent seal for inflatable devices comprising:

a first component for covering a vent opening of an inflatable device, the first component including hook and loop fastener material and being attached to an outer wall of the inflatable device near the vent opening, with hook and loop fastener material included on an area of the outer wall of the inflatable device around the vent opening; and a second component for covering the vent opening of the inflatable device from the inside of the inflatable device, the second component including hook and loop fastener material and being attached to an inner wall of the inflatable device near the vent opening;

wherein the first and second component are designed and positioned so that in a closed position the first component covers the vent opening and is affixed to the area of the outer wall of the inflatable device and the first component covers the vent opening and is affixed to the second component.

2. The vent seal of claim 1 wherein an area of the inner wall of the inflatable device around the vent opening includes hook and loop fastener material positioned so that in the closed position the second component is affixed to the inner wall.

3. The vent seal of claim 1 wherein the hook and loop fastener material included on the second component is about the size and shape of the vent opening.

4. The vent seal of claim 1 wherein the inflatable device is an inflatable screen.

5. The vent seal of claim 1 wherein the inflatable device is an air mattress.

6. The vent seal of claim 1 wherein the inflatable device is an inflatable light tower.

7. The vent seal of claim 1 wherein the inflatable device is an inflatable play structure.

8. The vent seal of claim 1 wherein the inflatable device is an inflatable tent.

9. An inflatable device comprising:

an inflatable structure including an inlet and an outlet;

a fastener material on an area of an outer wall of the inflatable structure around the outlet; and a sealable closure including:

a first component for covering the outlet attached to an outer wall of the inflatable device near the outlet and including fastener material on at least one side such that the first component is affixed to the area of the outer wall of the inflatable device around the outlet when positioned to cover the outlet;

a second component for covering the outlet attached to an inner wall of the inflatable device near the outlet and including fastener material on at least one side such that the second component is affixed to the first component when the first component and the second component are positioned to cover the outlet.

10. The inflatable device of claim 9 wherein the fastener is a hook and loop fastener.

11. The inflatable device of claim 9 wherein the first component and second component are partially sewn or welded to the inflatable device.

12. The inflatable device of claim 11 wherein the fastener material of the second component is about the size and shape of the outlet and the second component is arranged so that the fastener material of the second component aligns with the outlet when the second component is positioned to cover the outlet.

13. The inflatable device of claim 9 wherein the inflatable structure is a screen.

14. The inflatable device of claim 9 wherein the inflatable structure is an air mattress.

15. The inflatable device of claim 9 wherein the inflatable structure is a light tower.

16. The inflatable device of claim 9 wherein the inflatable structure is a play structure.

17. The inflatable device of claim 9 wherein the inflatable structure is a tent.

18. The inflatable device of claim 9 further including a fastener material on an area of an inner wall of the inflatable structure in the vicinity of the outlet such that the second component is affixed to the inner wall by the fastener material when the second component is positioned to cover the outlet.

19. A method for sealing vents of inflatable structures comprising the steps of:

inflating an inflatable structure;

closing an inner component of a seal over a vent opening, the inner component including hook and loop fastener material and being attached to an inner wall of the inflatable structure next to the vent opening; and closing an outer component of the seal over the vent opening, the outer component and an outer wall of the inflatable structure around the vent opening having hook and loop fastener material whereby the outer component is affixed to both the inner component and the outer wall of the inflatable structure around the vent opening.

* * * * *